US008658575B2

(12) United States Patent
Singh et al.

(10) Patent No.: US 8,658,575 B2
(45) Date of Patent: Feb. 25, 2014

(54) COMPOSITION OF INSULATING FLUID AND PROCESS FOR THE PREPARATION THEREOF

(75) Inventors: Arun Kumar Singh, Uttranchal (IN); Naval Kishore Pandey, Uttranchal (IN); Ashok Kumar Gupta, Uttranchal (IN)

(73) Assignee: Council of Scientific & Industrial Research, New Delhi (IN)

( * ) Notice: Subject to any disclaimer, the term of this patent is extended or adjusted under 35 U.S.C. 154(b) by 1930 days.

(21) Appl. No.: 11/386,576

(22) Filed: Mar. 21, 2006

(65) Prior Publication Data

US 2007/0060484 A1 Mar. 15, 2007

(30) Foreign Application Priority Data

Dec. 9, 2005 (IN) ..... 3336/DEL/2005

(51) Int. Cl.
*C10M 105/06* (2006.01)
*C10M 133/14* (2006.01)
*C10M 129/10* (2006.01)

(52) U.S. Cl.
USPC ..... 508/110; 508/192; 508/563; 508/584; 508/469; 508/391

(58) Field of Classification Search
USPC ..... 508/110, 192, 563, 584, 469, 391
See application file for complete search history.

(56) References Cited

U.S. PATENT DOCUMENTS

| | | | | |
|---|---|---|---|---|
| 2,595,557 | A * | 5/1952 | Worth et al. | 508/313 |
| 5,171,462 | A * | 12/1992 | DeRosa et al. | 508/281 |
| 5,498,809 | A * | 3/1996 | Emert et al. | 585/13 |
| 5,652,201 | A * | 7/1997 | Papay et al. | 508/228 |
| 6,340,658 | B1 | 1/2002 | Cannon et al. | |
| 6,485,659 | B1 | 11/2002 | Goedde et al. | |
| 6,491,809 | B1 * | 12/2002 | Briot et al. | 208/18 |
| 6,645,404 | B2 | 11/2003 | Oommen et al. | |
| 6,726,857 | B2 | 4/2004 | Goedde et al. | |
| 7,339,088 | B1 * | 3/2008 | O'Brien et al. | 585/804 |
| 2002/0010103 | A1 * | 1/2002 | Takayama et al. | 508/433 |

* cited by examiner

*Primary Examiner* — Jim Goloboy
(74) *Attorney, Agent, or Firm* — Abelman, Frayne & Schwab

(57) ABSTRACT

This invention provides a composition of insulating fluid and process for the preparation thereof that mainly contains alkyl benzenes. In addition to alkyl benzenes, the composition also contains an antioxidant, an antifoaming agent, a pour point dispersant, a corrosion inhibitor and a detergent-dispersant additive. The product of this invention has utility as an insulating fluid in electrical installations such as transformer.

16 Claims, No Drawings

COMPOSITION OF INSULATING FLUID AND PROCESS FOR THE PREPARATION THEREOF

FIELD OF THE INVENTION

The present invention relates to a composition insulating fluid and process for preparation thereof. This invention particularly relates to composition of insulating fluid that mainly contains alkyl benzenes. In addition to alkyl benzenes, the composition also contains an antioxidant, an antifoaming agent, a pour point dispersant, a corrosion inhibitor and a detergent-dispersant additive. The product of this invention has utility as an insulating fluid in electrical installations such as transformer.

BACKGROUND OF THE INVENTION

Enhancing the life of an electrical transformer is an essential part of a modern power operation technology. The aging or deterioration of insulating oil is normally associated with oxidation. Due to the presence of oxygen and water, insulating oil oxidizes even under ideal conditions. The insulating properties of the oil are also affected by contaminants from the solid materials in the transformer dissolving in the oil. The reaction between unstable hydrocarbons in the oil and oxygen, moisture or other chemicals in the atmosphere, with the assistance of accelerators such as heat, results in decay products in the oil. Mineral oil insulating fluids undergo oxidative degradation in the presence of oxygen to give a number of oxidation products. The final products of oxidation are acidic materials that can affect the characteristics of the insulating fluid as well as damage the components of the electrical unit. The high temperatures in due course cause the fluid to oxidize and ultimately produce sludge and soluble acid in sufficient quantity to impair its heat transfer and dielectric efficiency. Sludge formation is the terminal stage of the deterioration process. The acids formed in the process of oxidation attack on the cellulose fibers and metals forming metallic soaps, lacquers, aldehydes, alcohols and ketones which precipitate as heavy tarry acidic sludge on the insulation. Sludge appears faster in heavily loaded, hot running and abused transformers causing shrinkage of the insulation through leaching out varnishes and cellulose materials.

The main purpose of transformer oil is to insulate and cool the transformer. A specification is a good start, but to successfully find just the right oil for transformer, details are needed. All transformers and their requirements are different. And right oils are needed that are tailored for each transformer's need for availability, performance and its geographical conditions. The Naphthenic oils are the best, which have outstanding properties for use in a transformer. Much due to their low viscosity at high temperatures and excellent solvency at very low temperatures. They also have high oxidation stability and great electrical properties that make them the perfect choice for a transformer.

In the prior art for producing Insulating fluids, generally, mineral oils or mineral oil with synthetic fluids or synthetic fluid alone were used. The focus has been on the use of such oil base to enhance the performance.

Reference may be made to U.S. Pat. No. 6,726,857 and U.S. Pat. No. 6,485,659 Goedde, et al. Apr. 27, 2004 Cooper Industries, Inc. (Houston, Tex.) Dielectric fluid having defined chemical composition for use in electrical apparatus. The dielectric coolants for use in sealed, non-vented transformers, and have improved performance characteristics, including decreased degradation of the paper insulating layers, as well as a greater degree of safety and environmental acceptability. This consist of aromatic hydrocarbons (di or tri aryl ethane such as biphenyl ethane or ethyl naphthalene), polyalphaolefins, polyol esters, and natural vegetable oils, along with additives to improve pour point, increase stability and reduce oxidation rate. (blend of mineral oil, polyalphaolefins, polyol esters and natural vegetable oils)

Reference may be made to U.S. Pat. No. 6,645,404 Oommen, et al. Nov. 11, 2003 ABB Technology AG (Zurich, CH) High oleic acid oil compositions and methods of making and electrical insulation fluids and devices comprising the same. High oleic acid triglyceride having the properties of a dielectric strength of at least 35 KV/100 mil gap, a dissipation factor of less than 0.05% at 25 NC., acidity of less than 0.03 mg KOH/g, electrical conductivity of less than 1 pS/m at 25 NC., a flash point of at least 250 NC. and a pour point of at least −15 NC with additives are disclosed as electrical insulation fluids.

Reference may be made to U.S. Pat. No. 6,340,658 Cannon, et al. Jan. 22, 2002 Wavely Light and Power (Waverly, Iowa) Vegetable-based transformer oil and transmission line fluid. A vegetable oil-based electrically-insulating fluid is environmentally-friendly and has a high flash point and a high fire point. The base oil is hydrogenated to produce maximum possible stability of the oil, or alternatively, is a higher oleic acid oil. The vegetable oils of the preferred embodiments are soybean or corn oils. The oil can be winterized to remove crystallized fats and improve the pour point of the base oil, without the necessity of heating the oil. The base oil can also be combined with an additive package containing materials specifically designed for improved pour point, improved cooling properties, and improved dielectric stability. The fluid is useful in electrical components such as transformers and transmission lines. It also provides methods for making the fluid and fluid-filled electrical components.

A patent filled by the inventors of the present invention disclosed the use of Heavy Alkyl Benzene alkaline earth metal sulfonates are in use as detergent-dispersant-anti rust additive in various types of lubricants (Patent application IPA number 1306/DEL/1998 & 1307/DEL/1998 by A. K. Singh et al assigned to CSIR). The alkyl benzenes are mono, di and poly substituted alkyl aromatics having one benzene or toluene aromatic ring and straight or branched paraffinic chains having carbon atoms 1 to 15 preferably 10 to 15, preferably mono and di alkyl benzene. Alkyl benzenes are produced as by-products during the preparation of, (1) linear alkyl benzene (LAB) in detergent industry, (2) heavy aromatic produced in catalytic reformer, and (3) naphtha or gas steam cracker liquid product. Alkyl benzene consists of substituted benzenes and no poly-aromatics/condensed ring or olefinic compounds are present in the alkyl benzenes. It can be used as an alternate to mineral base stock of lubricants. It will reduce the hazard potential of the lubricants. It will provide required properties such as good insulating, dissipation of heat, stability, anti-corrosion properties and more eco-friendliness.

There is a need for developing new insulating fluid composition, which is free from harmful polynuclear aromatic hydrocarbons generally found in mineral oil and produce less pollution. These objectives must be met, while simultaneously satisfying stringent performance standards, e.g., good insulation, dissipation of heat, stability and anti-corrosion.

OBJECTIVES OF THE INVENTION

The main object of the present invention is to provide a composition insulating fluid and process for preparation thereof which obviates the drawbacks as detailed above.

Another object of the present invention is to provide a composition of insulating fluid and process for preparation thereof from alternate source based on alkyl benzenes obtained from various petrochemical or refinery waste streams such as heavy alkylates from LAB plants, higher aromatic from catalytic reformers or steam cracking plants.

Yet another object of the present invention is to avoid the use of polynuclear aromatic hydrocarbons, a component of mineral oil and reducing pollution potential of the insulating fluid formulation.

Yet another object of the present invention is to provide excellent miscibility of formulated insulating fluid with mineral, vegetable and synthetic oil in all proportions.

SUMMARY OF THE INVENTION

Accordingly the present invention provides a composition of insulating fluid comprising (i) base stoke of tailored heavy alkyl benzene having carbon atom mainly C14 to C18 in the range of 98.0-99.8 wt %, (ii) anti-oxidant in the range of 0.006-0.05% by weight (iii) detergent-dispersant in the range of 0.05-0.15% by weight, (iv) anti-foaming agent in the range of 0.01 to 1.0% by weight, (v) pour point dispersant in the range of 0.01 to 1.0% by weight, (vi) corrosion inhibitor in the range of 0.10-0.03% by weight, In yet another embodiment the composition of insulating fluid obtained has following characteristics:

(i) Kinetic viscosity at 27° C. is in the range of 10-20 cst, (ii) Viscosity index 60-100, (iii) Oxidation stability Pass (IP 48/97)

(iv) Rotatory bomb oxidation test (ROBOT) at 95° C. is 300-400 min., (v) Flash point 140-160° C., (vi) Pour point (−)15-25° C., (vii) Ash sulfated <0.05, (viii) Copper Strip corrosion test 1A, (ix) Foam test ASTM D130 Pass, (x) Interfacial tension against water 40-60 N/m, (xi) Reactive sulfur-NIL, (xii) Electrical strength 35-55 KV, (xiii) Dissipation factor 0.00058

(xiv) Specific resistance $39\times10^{12}$ Ohm, (xv) SK value is 3-5, (xvi) Density at 20° C. is 0.880-0.884.

(xvii) Biodegradability 40-60%.

In yet another embodiment the heavy alkyl benzene used is mono, di and poly substituted alkyl aromatics having one benzene aromatic ring and straight or branched paraffin chains having carbon atoms 14 to 18.

In yet another embodiment the heavy alkyl benzene fractions (C14-18) used is obtained from mono and di alkyl benzenes produced during the production of linear alkyl benzene (LAB) in detergent industry, heavy alkyl aromatics produced in catalytic reformer, and naphtha or gas steam cracker liquid product or mixture thereof.

In yet another embodiment the anti-oxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl)propionate, penta erythrityl tetrakis[3-(3,5-di-t-butyl-4-hydroxyphenyl)propionate], di-n-octadecyl(3,5-di-t-butyl-4-hydroxybenzyl)phosphonate, 2,4,6-tris(3,5-di-t-butyl-4-hydroxybenzyl)mesitylene, tris(3,5-di-t-butyl-4-hydroxybenzyl)isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl)phenol, 4,4'-methylenebis(-2,6-di-(t-butyl)phenol), Methyl hydroxy hydro cinnamide, phenothiazines derivatives, alkylated 5-amino tetrazole, di-ter.Butyl p-amino phenol and a mixture thereof.

In yet another embodiment the detergent-dispersant used is selected from the group consisting of calcium alkyl benzene sulfonate, sodium alkyl benzene sulfonate, propylene teramer succinimide of pentaethylene hexamine, octyl phosphonates and a mixture thereof.

In yet another embodiment the anti-foaming agent used is selected from the group consisting of silicone oil, polyvinyl alcohol, polyethers and a mixture thereof.

In yet another embodiment the pour point dispersant used is selected from the group consisting of diethylhexyl adipate, polymethacrylate, polyvinylacrylate and a mixture thereof.

In yet another embodiment the corrosion inhibitor used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

The present invention further provides a process for the preparation of a composition of insulating fluid, which comprises fractionating heavy alkylate fractions of linear alkyl benzene (LAB) or crackers, at a temperature in the range of 210-310° C., under vacuum distillation to obtain desired fractions of alkyl benzene having carbon atom C14 to C18 and viscosity in the range of 10-20 cst at about 27° C., removing the oxidized product from the above alkyl fractions by known methods to obtain a base stock, mixing 98.0-99.8 wt % of the above said base stock, at least one anti-oxidant in the range of 0.006-0.05 W %, at least one detergent-dispersant in the range of 0.05-0.15 W %, at least one anti-foaming agent in the range of 0.01 to 1.0 W %, at least one pour point dispersant in the range of 0.01 to 1.0 W %, at least one corrosion inhibitor in the range of 0.10-0.03 W %, under stirring, at a temperature in the range of 50-90° C. to obtain the desired insulating oil composition.

In yet another embodiment the heavy alkyl benzene used is mono, di and poly substituted alkyl aromatics having one benzene aromatic ring and straight or branched paraffinic chains having carbon atoms mainly C14 to C18.

In yet another embodiment the heavy alkyl benzene fractions (C14-18) used is obtained from mono and di alkyl benzenes produced during the production of linear alkyl benzene (LAB) in detergent industry, heavy alkyl aromatics produced in catalytic reformer, and naphtha or gas steam cracker liquid product or mixture thereof.

In yet another embodiment the anti-oxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl)propionate, penta erythrityl tetrakis[3-(3,5-di-t-butyl-4-hydroxyphenyl)propionate], di-n-octadecyl(3,5-di-t-butyl-4-hydroxybenzyl)phosphonate, 2,4,6-tris(3,5-di-t-butyl-4-hydroxybenzyl)mesitylene, tris(3,5-di-t-butyl-4-hydroxybenzyl)isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl) phenol, 4-methyl-2,6-di-(t-butyl)phenol, 4,4'-methylenebis(-2,6-di-(t-butyl)phenol), Methyl hydroxy hydro cinnamide, phenothiazines derivatives, alkylated 5-amino tetrazole, di-ter.Butyl p-amino phenol and a mixture thereof.

In yet another embodiment the detergent-dispersant used is selected from the group consisting of calcium alkyl benzene sulfonate, sodium alkyl benzene sulfonate, propylene teramer succinimide of pentaethylene hexamine, octyl phosphonates and a mixture thereof.

A process according to claim 10, wherein the anti-foaming agent used is selected from the group consisting of silicone oil, polyvinyl alcohol, polyethers and a mixture thereof.

In yet another embodiment the pour point dispersant used is selected from the group consisting of diethylhexyl adipate, polymethacrylate, polyvinylacrylate and a mixture thereof.

In yet another embodiment the corrosion inhibitor used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

In yet another embodiment the lubricating oil composition obtained has the following characteristics:

(i) Kinetic viscosity at 27° C. is in the range of 10-20 cst,
(ii) Viscosity index 60-100,
(iii) Oxidation stability Pass (IP 48/97)
(iv) Rotatory bomb oxidation test (ROBOT) at 95° C. is 300-400 min.,
(v) Flash point 140-160° C.,
(vi) Pour point (−)15-25° C.,
(vii) Ash sulfated <0.05,
(viii) Copper Strip corrosion test 1A,
(ix) Foam test ASTM D130 Pass,
(x) Interfacial tension against water 40-60 N/m,
(xi) Reactive sulfur-NIL,
(xii) Electrical strength 35-55 KV,
(xiii) Dissipation factor 0.00058
(xiv) Specific resistance $39\times10^{12}$ Ohm,
(xv) SK value is 3-5,
(xvi) Density at 20° C. is 0.880-0.884,
(xvii) Biodegradability 40-60%.

Comparison of properties of insulating fluid

| SN. | Properties | U.S. Pat. No. 6485659 mix | U.S. Pat. No. 6645404 vegetable | Our claim alkylate | Remarks |
|---|---|---|---|---|---|
| 1 | Kinetic Viscosity at 27° C., centistokes | — | — | 11.8 | |
| 2 | Flash Point, ° C. | 250 | 250 | 152 | inferior but more than requirement of 140° C. |
| 5 | Electrical strength | 35 | 35 | 45 | Better |
| 6 | cost | high | high | low | Better |
| 7 | Polynuclear Aromatics presence | yes | no | No | Better |

The composition are significantly non-toxic having no polynuclear aromatic, biodegradable in the range of 20 to 60%, Flash point 130 to 200° C., pour point less than (−)10° C., Kinematic viscosity at 27° C. 2 to 27 cst, Interfacial tension 10-60 N/m, Electrical strength 30 to 80 KV, Dissipation Factor 0.0001 to 0.00058, Sp.resistance $30\text{-}40\times10^{12}$, SK value 4 to 10, Oxidation stability (RoBOT) 200 to 400 min, water 1 to 40 ppm, TAN below 0.01 mgKOH, copper corrosion below 1 and able to replace the traditional mineral lube oils. The main advantages are, it reduces use of petroleum, offer better use of petrochemical waste product, cheaper than synthetic oil, product is more biodegradable and eco-freindly than petroleum lubes, safe to use due to higher flash point and non-toxicity.

The following examples are given by the way of illustration and therefore should not be construed to limit the scope of the invention.

EXAMPLE 1

TAILORING OF ALKYLATE: commercial heavy alkylates, a heavy waste fraction of detergent class linear alkyl benzene (LAB), was fractionated by vacuum distillation. The lighter cut having 50 weight percent of total alkylate was taken for base-stock preparation. The typical properties of the alkylate are

| | |
|---|---|
| Density at 15° C., gm/ml | 0.8748 |
| Kinetic viscosity at 27° C., cst | 26.75 |
| Viscosity index | 95 |
| Refractive index at 20° C. | 1.48426 |
| Pour point | (−)27° C. |
| Molecular weight | 403 ± 5 |
| RoBOT oxidation stability at 95° C. | 200 minuts |
| Distillation range | Up to 307° C. |
| Poly-aromatics or olefinic compounds | Negligible |

EXAMPLE 2

TAILORING OF ALKYLATE: commercial alkylates, a waste alkyl benzene from cracker unit, was fractionated by vacuum distillation. The lighter cut having 55 weight percent of total alkylate was taken for base-stock preparation. The typical properties of the alkylate are

| | |
|---|---|
| Density at 15° C., gm/ml | 0.8703 |
| Kinetic viscosity at 27° C., cst | 25.11 |
| Viscosity index | 98 |
| Refractive index at 20° C. | 1.48006 |
| Pour point | (−)22° C. |
| Molecular weight | 408 ± 5 |
| RoBOT oxidation stability at 95° C. | 190 minuts |
| Distillation range | Up to 291° C. |
| Poly-aromatics or olefinic compounds | Negligible |

EXAMPLE 3

Preparation of Base Stock

Tailored heavy alkylate was passed through silica gel column to remove oxidized product or treated with absorbent clay such as fuller's earth by mixing and thoroughly stirred for 50 minutes at 80° C. and filtering it through G-4 sintered glass funnel. The typical physico-chemical characteristics of the heavy alkylate are:

| | |
|---|---|
| Electrical strength (break down) | 40 KV |
| Kinetic viscosity at 27° C., cst | 26.62 |
| Viscosity index | 104 |
| Oxidation Stability, IP 48/97 | Pass - increase in viscosity 0.75% |
| Pour point | (−)28° C. |
| RoBOT test 95° C. | 250 minutes |
| Flash point | 152° C. |
| Acid number, mg KOH | 0.005 |
| Poly-aromatics or olefinic compounds | Negligible |

EXAMPLE 4

Preparation of Base Stock

Tailored alkylate from cracker unit was passed through silica gel column to remove oxidized product or treated with absorbent clay such as fuller's earth by mixing and thoroughly stirred for 50 minutes at 80° C. and filtering it through G-4 sintered glass funnel. The typical physico-chemical characteristics of the base oil was,

| | |
|---|---|
| Electrical strength (break down) | 38 KV |
| Kinetic viscosity at 27° C., cst | 24.03 |
| Viscosity index | 109 |
| Oxidation Stability, IP 48/97 | Pass - increase in viscosity 0.79% |
| Pour point | (−)26° C. |
| RoBOT test 95° C. | 210 minutes |
| Flash point | 153° C. |
| Acid number, mg KOH | 0.005 |
| Poly-aromatics or olefinic compounds | Negligible |

EXAMPLE 5

Preparation of Base Stock

Tailored alkylate from cracker unit and LAB plant were passed through silica gel column to remove oxidized product. 50 wt % of heavy alkylate and 50 wt % of alkylate from cracker unit were mixed and thoroughly stirred for 50 minutes at 60° C. The typical physico-chemical characteristics of the blended base oil was,

| | |
|---|---|
| Electrical strength (break down) | 39 KV |
| Kinetic viscosity at 27° C., cst | 25.83 |
| Viscosity index | 104 |
| Oxidation Stability, IP 48/97 | Pass - increase in viscosity 0.8% |
| Pour point | (−)28° C. |
| RoBOT test 95° C. | 220 minutes |
| Flash point | 150° C. |
| Acid number, mg KOH | 0.005 |
| Poly-aromatics or olefinic compounds | Negligible |

EXAMPLE 6

Preparation of Lube Oil from Base Stock

The base stock was blended with additive octyl 5amino tetrazole as a high temperature anti-oxidant in 200 ppm, Methyl Hydroxy Hydro Cinnamate as low temperature anti-oxidant-lubricity additives in 80 ppm, pentaethylene hexamine dodecyl succinimide as detergent-dispersant in 100 ppm, Silicone polymer oil as antifoaming agent—pour point depressant and calcium HAB sulfonate as corrosion inhibitors having base number 500 in 150 ppm concentration. The doping was done at 60° C. with stirring for 2 hours.

EXAMPLE 7

Preparation of Lube Oil from Base Stock

The base stock was blended with additive p-p-dioctyl diphenyl amine as a high temperature anti-oxidant in 100 ppm, zinc dialkyl dithio phosphate as low temperature anti-oxidant-lubricity additives in 50 ppm, octyl phosphonate as detergent-dispersant in 100 ppm, poly vinyl acrylate as anti-foaming agent—pour point depressant and alkyl benzotriazole as corrosion inhibitors having base number 500 in 50 ppm concentration. The doping was done at 60° C. with stirring for 2 hours.

EXAMPLE 8

Preparation of Lube Oil from Base Stock

The base stock was blended with additive di-t-butyl 4-methyl phenol as a high temperature anti-oxidant in 100 ppm, Methyl Hydroxy Hydro Cinnamate as low temperature anti-oxidant-lubricity additives in 150 ppm, pentaethylene hexamine propylene tetramer succinimide as detergent-dispersant in 100 ppm, polymethacrylate as antifoaming agent—pour point depressant and polyoxyalkylene polyol as corrosion inhibitors in 150 ppm concentration. The doping was done at 60° C. with stirring for 2 hours.

EXAMPLE 9

Preparation of Lube Oil from Base Stock

The base stock was blended with additive n-naphthyl 2-phenylamine as a high temperature anti-oxidant in 200 ppm, Zinc dialkyl dithiophosphate as low temperature anti-oxidant-lubricity additives in 250 ppm, pentaethylene hexamine propylene tetramer succinimide as detergent-dispersant in 200 ppm, Silicone polymer oil as antifoaming agent—pour point depressant and octadecyl amine as corrosion inhibitors in 150 ppm concentration. The doping was done at 60° C. with stirring for 2 hours.

EXAMPLE 10

CHARACTERIZATION AND EVALUATION OF LUBE OIL: The formulations were analyzed and evaluated as per ASTM or BIS methods such as ASTM D445/BIS-14234, P25/56—K. Viscosity & Viscosity index, ASTM D 92/BIS-P21/69—Flash point, ASTM D1217/BIS-P16—Rel. Density, ASTM D130/BIS-P15—Copper corrosion, ASTM D97/BIS-P10—Pour point, ASTM D874/BIS-P4—Ash sulfated, ASTM D 664/BIS-P1—TAN, ASTM D4377/BIS-P40—Water, IP 280, 306, 307—Oxidation Test, ASTM D3711—Cocking test.

EXAMPLE 11

EVALUATION: The typical values estimated are, viscosity cst at 27° C. was 11.8, viscosity index was 61, flash point 152° C., pour point (−)18° C., copper corrosion <1, Total acid number 0.001 mgKOH, Foaming test pass, biodegradability 45%, Interfacial tension against water 51 N/m, reactive sulfur nil, Electrical strength 45 KV, Dissipation factor 0.00058, Specific resistance $39\times10^{12}$, SK value 4, Oxidation stability (RoBOT at 95° C.) 333 min, water 15 ppm, Density 20° C. 0.881 and oxidation inhibitor 0.15%.

The advantage of this invention that the composition of the insulating fluid based on alkyl benzene obtained from an alternate source of the present invention is free from condensed aromatic, eco-friendly and provides better or equivalent performance as mineral oil based insulating fluids.

We claim:

1. A process for the preparation of a composition of insulating fluid, which comprises fractionating heavy alkylate fractions of linear alkyl benzene (LAB) or crackers, at a temperature in the range of 210-310° C., under vacuum distillation to obtain dialkylbenzenes having 14 to 18 carbon atoms and viscosity in the range of 10-20 cst at about 27° C., removing the oxidized product from the above alkyl fractions to obtain a base stock, mixing 98.0-99.8 wt % of the above said base stock, at least one anti-oxidant in the range of 0.006-0.05 W %, at least one detergent-depressant in the range of 0.05-0.15 W %, at least one anti-foaming agent in the range of 0.01 to 1.0 W %, at least one pour point depressant in the range of 0.01 to 1.0 W %, at least one corrosion inhibitor in the range of 0.10-0.03 W %, under stirring, at a temperature in the range of 50-90° C. to obtain the desired insulating oil composition.

2. The process according to claim 1, wherein the heavy alkyl benzene fractions (C14-18) used are obtained from mono and di alkyl benzenes produced during the production of linear alkyl benzene (LAB) in the detergent industry, heavy alkyl aromatics produced in catalytic reformer, and naphtha or gas steam cracker liquid product or mixture thereof.

3. The process according to claim 1, wherein the anti-oxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl)propionate, penta erythrityl tetrakis[3-(3,5-di-t-butyl-4-hydroxyphenyl)propionate], di-n-octadecyl(3,5-di-t-butyl-4-hydroxybenzyl)phosphonate, 2,4,6-tris(3,5-di-t-butyl-4-hydroxybenzyl)mesitylene, tris(3,5-di-t-butyl-4-hydroxybenzyl)isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl)phenol, 4,4'-methylenebis(-2,6-di-(t-butyl)phenol), Methyl hydroxy hydro cinnamide, phenothiazines derivatives, alkylated 5-amino tetrazole, di-ter.Butyl p-amino phenol and a mixture thereof.

4. The process according to claim 1, wherein the detergent-dispersant used is selected from the group consisting of calcium alkyl benzene sulfonate, sodium alkyl benzene sulfonate, propylene teramer succinimide of pentaethylene hexamine, octyl phosphonates and a mixture thereof.

5. The process according to claim 1, wherein the anti-foaming agent used is selected from the group consisting of silicone oil, polyvinyl alcohol, polyethers and a mixture thereof.

6. The process according to claim 1, wherein the pour point depressant used is selected from the group consisting of diethylhexyl adipate, polymethacrylate, polyvinylacrylate and a mixture thereof.

7. The process according to claim 1, wherein the corrosion inhibitor used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

8. The process according to claim 1, wherein the composition obtained has the following characteristics:

(i) Kinetic viscosity at 27[deg.] C. is in the range of 10-20 cst,
(ii) Viscosity index 60-100,
(iii) Oxidation stability Pass (IP 48/97)
(iv) Rotatory bomb oxidation test (ROBOT) at 95[deg.] C. is 300-400 min.,
(v) Flash point 140-160[deg.] C.,
(vi) Pour point (−)15-25[deg.] C.,
(vii) Ash sulfated <0.05,
(viii) Copper Strip corrosion test 1A,
(ix) Foam test ASTM D130 Pass,
(x) Interfacial tension against water 40-60 N/m,
(xi) Reactive sulfur-NIL,
(xii) Electrical strength 35-55 KV,
(xiii) Dissipation factor 0.00058
(xiv) Specific resistance $39*39\times10^{12}$ Ohm·m,
(xv) SK value is 3-5,
(xvi) Density at 20[deg.] C. is 0.880-0.884,
(xvii) Biodegradability 40-60%.

9. A composition of insulating fluid comprising:

(i) a base stock of tailored heavy alkyl benzene comprising a major portion of dialkylbenzene having a paraffin chain of 14 to 18 carbon atoms in the range of 98.0-99.8 wt %, and obtainable by the process of claim 1,
(ii) anti-oxidant in the range of 0.006-0.05% by weight,
(iii) detergent-dispersant in the range of 0.05-0.15% by weight,
(iv) anti-foaming agent in the range of 0.01 to 1.0% by weight,
(v) pour point depressant in the range of 0.01 to 1.0% by weight,
(vi) corrosion inhibitor in the range of 0.10-0.03% by weight, wherein the composition has electric strength in the range of 30-80 KV, dissipation factor in the range of 0.0001 to 0.00058 and specific resistance in the range of $30\text{-}40\times10^{12}$ Ohm·m.

10. The composition of insulating fluid according to claim 9 having the following characteristics:

(i) Kinetic viscosity at 27.degree. C. is in the range of 10-20 cst,
(ii) Viscosity index 60-100, (iii) Oxidation stability Pass (IP 48/97)
(iv) Rotatory bomb oxidation test (ROBOT) at 95.degree. C. is 300-400 min.,
(v) Flash point 140-160.degree. C.,
(vi) Pour point (−) 15-25.degree. C.,
(vii) Ash sulfated <0.05,
(viii) Copper Strip corrosion test 1A,
(ix) Foam test ASTM D130 Pass,
(x) Interfacial tension against water 40-60 N/m,
(xi) Reactive sulfur-NIL, (xii) Electrical strength 35-55 KV,
(xii) Dissipation factor 0.00058
(xiii) Electric strength 35-55 KV
(xiv) Specific resistance $39\times10^{12}$ Ohm,
(xv) SK value is 3-5,
(xvi) Density at 20° C. is 0.880-0.884,
(xvii) Biodegradability 40-60%.

11. The composition according to claim 9, wherein the heavy alkyl benzene fractions (C14-18) used are obtained from di alkyl benzenes produced during the production of linear alkyl benzene (LAB) in detergent industry, heavy alkyl aromatics produced in catalytic reformer, and naphtha or gas steam cracker liquid product or mixture thereof.

12. The composition according to claim 9, wherein the anti-oxidant used is selected from the group consisting of 2,4,6-tri-tert-butylphenol, 2,6-di-tert-butyl-4-n-butylphenol, 2,6-di-t-butyl-4-methylphenol or n-octadecyl 3-(3,5-di-t-butyl-4-hydroxy phenyl)propionate, penta erythrityl tetrakis[3-(3,5-di-t-butyl-4-hydroxyphenyl)propionate], di-n-octadecyl (3,5-di-t-butyl-4-hydroxybenzyl)phosphonate, 2,4,6-tris(3,5-di-t-butyl-4-hydroxybenzyl)mesitylene, tris(3,5-di-t-butyl-4-hydroxybenzyl)isocyanurate or hindered piperidine carboxylic acids, acylated derivatives of 2,6-dihydroxy-9-azabicyclo[3.3.1]nonane or bicyclic hindered amines or diphenylamines or dinaphthylamines, phenylnaphthyl amines, N,N'-diphenylphenylenediamine or p-octyldiphenylamine, p,p-dioctyl diphenylamine, N-phenyl-1-naphthylamine, N-phenyl-2-naphthylamine, N-(p-dodecyl)phenyl-2-naphthylamine, di-1-naphthylamine, di-2naphthylamine, N-alkyl phenothiazines, imino(bisbenzyl), 6-(t-butyl)phenol, 2,6-di-(t-butyl)phenol, 4-methyl-2,6-di-(t-butyl)phenol, 4,4'-methylenebis(-2,6-di-(t-butyl)phenol), Methyl hydroxy hydro cinnamide, phenothiazines derivatives, alkylated 5-amino tetrazole, di-ter.Butyl p-amino phenol and a mixture thereof.

13. The composition according to claim 9, wherein the detergent-dispersant used is selected from the group consisting of calcium alkyl benzene sulfonate, sodium alkyl benzene sulfonate, propylene tetramer succinimide of pentaethylene hexamine, octyl phosphonates and a mixture thereof.

14. The composition according to claim 9, wherein the anti-foaming agent used is selected from the group consisting of silicone oil, polyvinyl alcohol, polyethers and a mixture thereof.

15. The composition according to claim 9, wherein the pour point depressant used is selected from the group consisting of diethylhexyl adipate, polymethacrylate, polyvinylacrylate and a mixture thereof.

16. The composition according to claim 9, wherein the corrosion inhibitor used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated pentadecyl phenol, magnesium alkyl benzene sulfonates and a mixture thereof.

* * * * *